US007106877B1

(12) United States Patent
Linville

(10) Patent No.: US 7,106,877 B1
(45) Date of Patent: Sep. 12, 2006

(54) EARLOOP FOR TELECOMMUNICATIONS HEADSET

(75) Inventor: Larry R. Linville, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 516 days.

(21) Appl. No.: 10/719,822

(22) Filed: Nov. 21, 2003

(51) Int. Cl.
*H04R 25/00* (2006.01)

(52) U.S. Cl. ..... 381/381; 381/370; 381/374

(58) Field of Classification Search ..... 381/309, 381/330, 370, 374, 375, 376, 378, 379; 379/430; 2/209; 455/575.1, 575.2; 181/129, 130, 181/135
See application file for complete search history.

(56) References Cited

U.S. PATENT DOCUMENTS 6,449,374 B1 * 9/2002 Skulley et al. ..... 381/381
2004/0141628 A1 * 7/2004 Villaverde et al. ..... 381/381
2004/0264720 A1 * 12/2004 Huang et al. ..... 381/315

* cited by examiner

*Primary Examiner*—Huyen Le
(74) *Attorney, Agent, or Firm*—Jung-hua Kuo

(57) ABSTRACT

Earloops with improved post design for increased reliability and quality for over-the-ear style headsets are disclosed. The earloop includes an earloop main body having connecting and stabilizer portions and a post extending from the connection portion for insertion into a corresponding opening in an audio receiver/transmitter assembly. An embedded hardened steel member extends from the post into the connection portion. The stabilizer portion is configured to be positioned over, around and behind a user's ear. The earloop may be incorporated in a headset that includes the audio receiver/transmitter assembly that defines an opening to receive the post therethrough. The audio assembly may be positionable along a length of the post and rotatable about the post. The hardened steel member increases the stiffness and strength and minimizes breakage of the post and thus increases the reliability, quality, and useful life of the earloop and/or headset.

17 Claims, 2 Drawing Sheets

EARLOOP FOR TELECOMMUNICATIONS HEADSET

BACKGROUND OF THE INVENTION

1. Field of the Invention

The present invention relates generally to headsets for use in telecommunications, telephony, and/or multimedia applications. More specifically, earloops with improved post design for increased reliability and quality for over-the-ear style headsets are disclosed.

2. Description of Related Art

Communication headsets are used in numerous applications and are particularly effective for telephone operators, radio operators, aircraft personnel, and for other individuals for whom it is desirable to have hands free operation of communication systems. Accordingly, a wide variety of conventional headsets are available.

One type of communication headset is a monaural headset. Monaural headsets are headsets that have only a single audio receiver for placement near one ear. Often, such headsets are implemented with an earloop or earhook that is configured to fit around the ear to secure the receiver in place. Such headsets may be very compact.

One example of a monaural headset includes as an earloop to which an audio receiver/transmitter assembly is attached. The audio receiver/transmitter assembly may be in the form of a microphone boom, for example. The earloop may provide a post for insertion into a mating opening in the audio receiver/transmitter assembly. The post and opening preferably provide a frictional fit therebetween to removably and rotatably secure the audio receiver/transmitter assembly to the earloop. In particular, the audio receiver/transmitter assembly may be rotated about the post of the earloop so as to adjust the position of the microphone relative to the earloop and thereby locate the microphone at a desired location relative to the user's mouth.

However, because of the large natural variations in the size, shape, and orientation of human ears, over-the-ear style headsets often do not provide an optimal fit for many potential users and/or require the user to make various adjustments to the earloop and/or the audio receiver/transmitter assembly to try to achieve a proper fit. For example, earloops often do not fit snugly and thus may be unstable and/or uncomfortable for a large spectrum of potential users. In addition, the ergonomic goals of stability and comfort are often in conflict since a snug fit that provides a secure attachment for the headset often pinches the ear or creates pressure points that are uncomfortable for many users, particularly when the headset is worn for an extended period of time.

Although the earloop may provide various adjustable features, the post of the earloop is typically provided only for engagement with the audio receiver/transmitter assembly and is not meant to be adjusted for proper fit to the ear. Nonetheless, the user may attempt to bend or otherwise adjust the post in an attempt to achieve a better fit. The post may thus break under fatigue with the user's repeated attempts at adjusting the post, reducing the useful life of the headset.

Thus, what is needed is an earloop that provides increased reliability and quality to minimize breakage of the earloop. Ideally, the earloop would provide the increased reliability and quality while still providing adjustability to ensure proper fit.

SUMMARY OF THE INVENTION

Earloops with improved post design for increased reliability and quality for over-the-ear style headsets are disclosed. It should be appreciated that the present invention can be implemented in numerous ways, including as a process, an apparatus, a system, a device, a method, or a computer readable medium such as a computer readable storage medium or a computer network wherein program instructions are sent over optical or electronic communication lines. Several inventive embodiments of the present invention are described below.

The earloop generally includes an earloop main body having connecting and stabilizer portions and a post extending from the connection portion configured to be inserted into a corresponding opening defined in an audio receiver and/or transmitter assembly. The earloop also includes an embedded hardened steel member, e.g., a wire, extending from the post into the connection portion. The stabilizer portion is configured to be positioned at least partially over, around and behind a user's ear. The hardened steel member has a high tensile strength so as to increase the stiffness and strength of the plastic post. The stiffer and stronger post also provides feedback to the user that the post should not be bent and that the position of the post should not be adjusted relative to the earloop main body. The embedded hardened steel wire helps to minimize breakage of the earloop post and thus increases the reliability, quality, and useful life of the headset.

In one embodiment, the hardened steel member may extend substantially the entire length of the post and may include a bend at approximately a juncture between the connecting portion and the post. The post may be approximately 0.8 inches in length and 0.10 inches in diameter and may be integrally formed with the earloop. The hardened steel member may be approximately 2 inches in length and approximately 0.04 inches in diameter.

The earloop may be incorporated in a headset that also includes an audio assembly having a receiver element and/or a transmitter element and defining an opening configured to receive the post therethrough. The audio assembly may be positionable along a length of the post and rotatable about the post. A rubber grommet may be disposed within the audio assembly opening to provide a frictional fit between the audio assembly opening and the post.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Earloops with improved post design for increased reliability and quality for over-the-ear style headsets are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Figure 1:
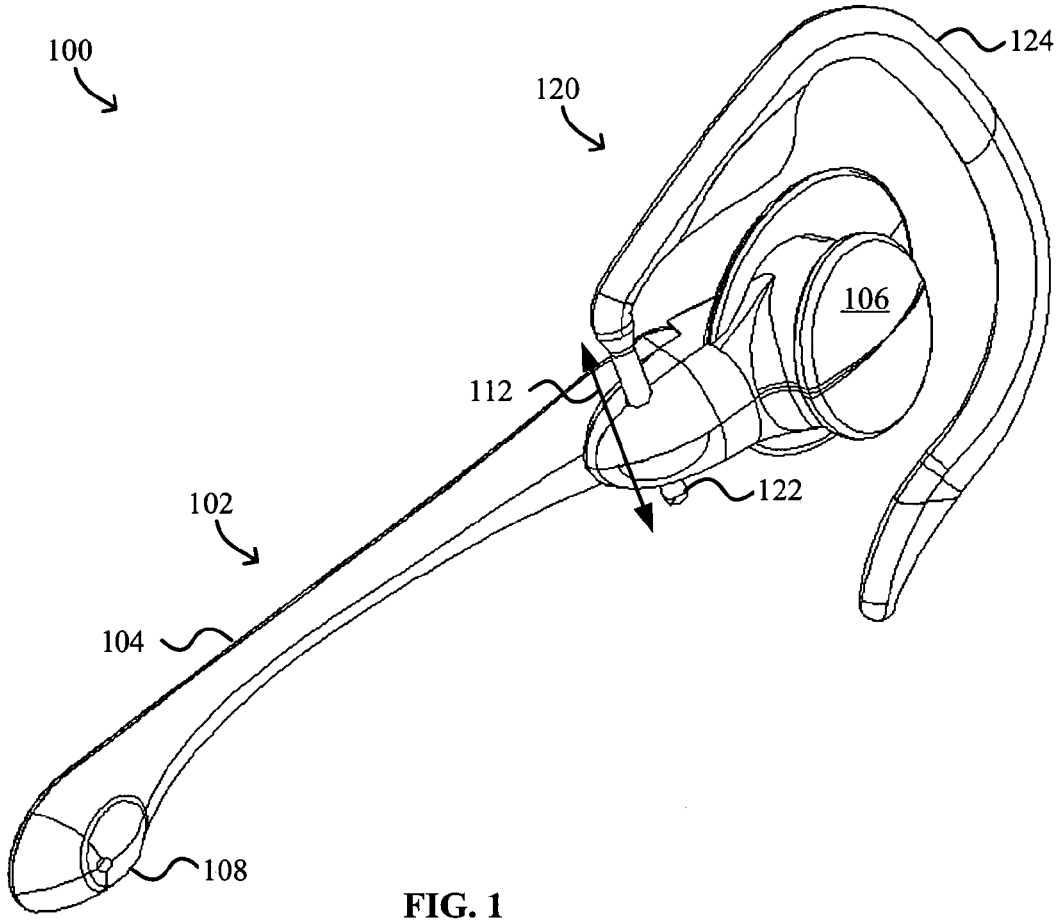
FIG. 1 is a perspective view of an illustrative headset including an audio receiver/transmitter assembly coupled to an earloop.
Figure 2:
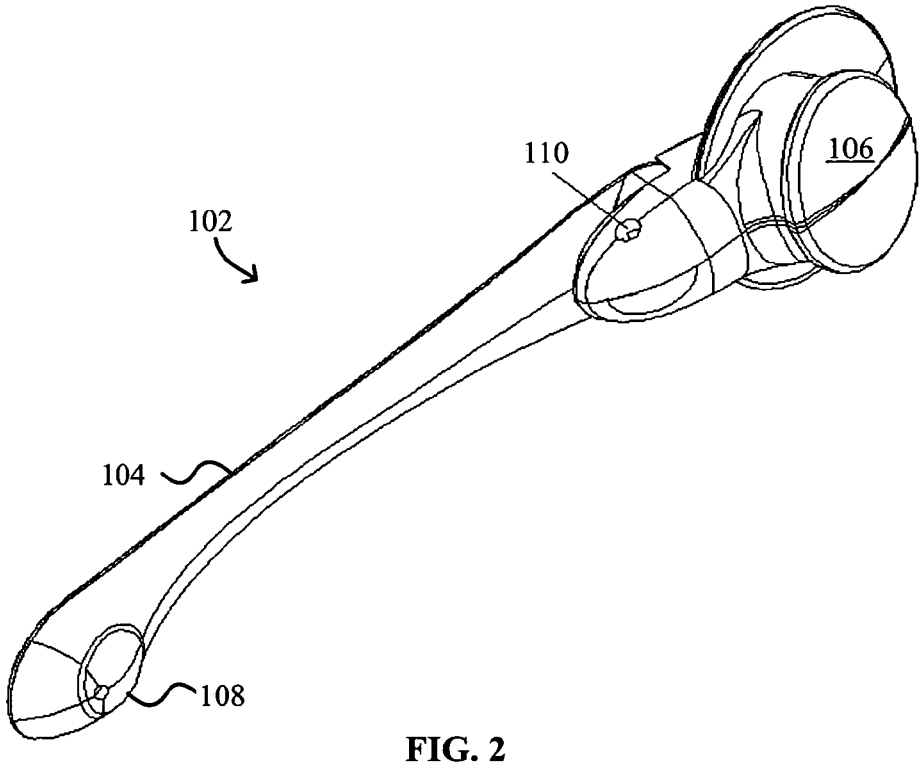
FIG. 2 is a perspective view of the audio receiver/transmitter assembly of FIG. 1.

FIG. 1 is a perspective view of an illustrative headset 100 including an audio receiver/transmitter assembly 102 coupled to an over-the-ear earloop 120 and FIG. 2 is a perspective view illustrating the audio receiver/transmitter assembly 102 of FIG. 1 in more detail. The headset 100 is merely one example of a monaural over-the-ear style headset with an illustrative earloop 120. In the example shown, the audio receiver/transmitter assembly 102 includes a housing 104 that houses a receiver element 106 such as a speaker and a transmitter element 108, typically a boom microphone or a sound tube (not shown). The housing 104 defines a hole or opening 110 for receiving a corresponding post 122 of the earloop 120 to form a joint. The post 122 may be a separate component or an integral part of the earloop 120. The joint allows the user to selectively position the audio receiver/transmitter assembly 102 relative to the earloop 120 to secure the receiver element 106 over the user's ear and to position the transmitter element 108 near the user's mouth. The post 122 of the earloop 120 is coupled to or extends from a connecting portion 124*a* of an earloop main body 124. The earloop main body 124 may also include a rigid curved stabilizer portion 124*b* and an adjustable or flexible tail portion 124*c*, and a rigid tail tip portion 124*d*. The rigid curved stabilizer and the adjustable tail portions 124*b*, 124*c* are preferably configured to be positioned at least partially over, around and behind a user's ear so as to clip the earloop 120 onto the user's ear.

It is noted that the audio assembly 102 configured to be coupled to the earloop 120 need not include both the receiver element 106 and the transmitter element 108. For example, the audio assembly 102 may include only the receiver element 106 without a transmitter element 108 for applications that do not require an audio transmitter 108. As another example, the audio assembly 102 may include only the transmitter element 108 without a receiver element 106 for applications that do not require a receiver 106.

Because of the large natural variations in the size, shape, and orientation of human ears, over-the-ear style headsets such as the one shown in FIG. 1 may provide various adjustments that each particular user may make to the earloop 120 and/or the audio receiver/transmitter assembly 102 in order to try to achieve a proper fit for each particular user. For example, the curvature, the inward/outward bend, and/or the positioning relative to the particular user's ear of the earloop main body 124 may be adjusted. In addition, the audio receiver/transmitter assembly 102 may be adjustable relative to the earloop 120. Any other suitable combinations of adjustable features may also be implemented by the earloop 120.

To provide adjustability of the audio receiver/transmitter assembly 102 relative to the earloop 120, the audio receiver/transmitter assembly 102 may be rotatable about and positionable along the length of the post 122 of the earloop 120. In particular, the opening 110 defined by the housing 104 is preferably a through opening such that the audio receiver/transmitter assembly 102 is movable in a direction as indicated by arrow 112 and thus may be selectively positioned along the length of the post 122. In addition, the audio receiver/transmitter assembly 102 is preferably rotatable about the post 122. The opening 110 and the post 122 are preferably dimensioned to provide a frictional fit therebetween such that once the audio receiver/transmitter assembly 102 is positioned along direction 112 and about the post 122, the audio receiver/transmitter assembly 102 remains generally fixed relatively to the earloop 120. For example, a rubber grommet (not shown) may be provided in the opening 110 of the audio assembly housing 104 to provide the frictional fit between the opening 110 of the audio receiver/transmitter assembly 102 and the post 122. The audio receiver/transmitter assembly 102 may also be removable from the earloop 120. As is evident, the cooperation between the post 122 and the opening 110 enables selective positioning of the audio receiver/transmitter assembly 102 relative to the earloop 120 to allow for adjustments of the audio receiver/transmitter assembly 102 for each particular user.

In contrast to the adjustability of the audio receiver/transmitter assembly 102 relative to the earloop 120, the post 122 of the earloop 120 is generally provided for engagement with the opening 110 of the audio receiver/transmitter assembly 102 and is not meant to be otherwise adjusted relative to the earloop main body 124 of the earloop 120 for proper fit to the user's ear. Nevertheless, the user may attempt to bend or otherwise adjust the post 122 relative to the earloop main body 124 of the earloop 120 in an attempt to achieve a better fit. In addition, the user may also repeatedly insert and remove the earloop 120 from the audio receiver/transmitter assembly 102 for use and storage, for example.

The post 122 thus preferably would not easily break under fatigue even with the user's repeated attempts at adjusting the post 122 relative to the earloop main body 124 and/or the user's repeated insertion and removal of the earloop 120 into and out of the hole 122 provided by the audio receiver/transmitter assembly 102 so as to increase the useful life of the headset 100. The post 122 and the earloop main body 124 are typically made of plastic, e.g., polycarbonate (PC)/acrylonitrile butadiene styrene (ABS), such that breakage of the post 122 from the earloop main body 124 would render the headset 100 unusable. In addition, the post 122 is preferably also of sufficient stiffness so as to provide feedback to the user that the position of the post 122 should not be adjusted relative to the earloop main body 124 of the earloop 120.

Figure 3:
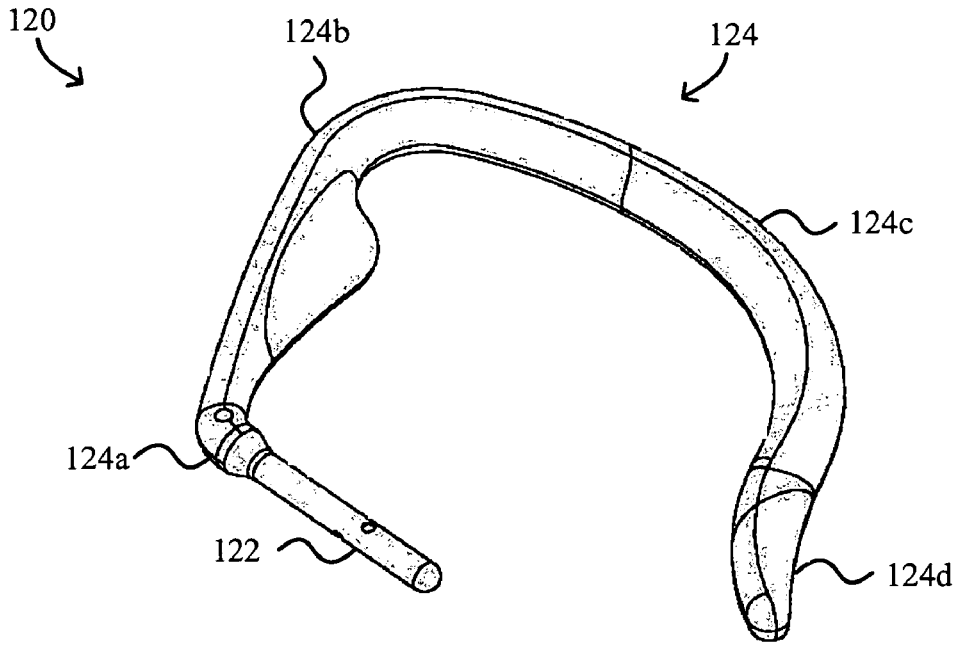
FIG. 3 is a perspective view of the earloop of the headset of FIG. 1.
Figure 4:
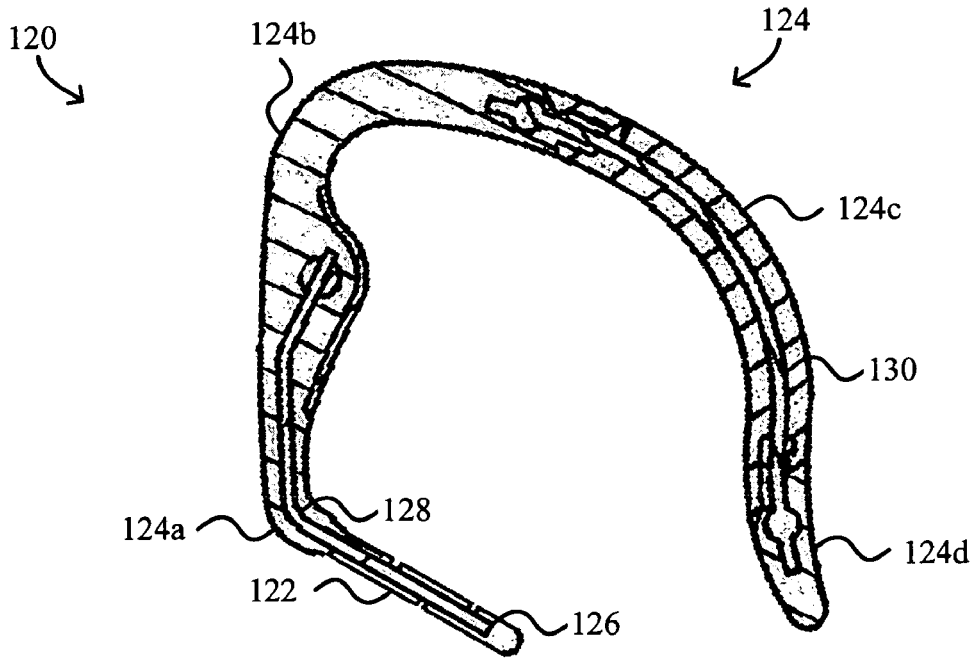
FIG. 4 is a cross-sectional view of the earloop of the headset of FIG. 1.

FIG. 3 is a perspective view and FIG. 4 is a cross-sectional view of the earloop 120 of the headset 100 of FIG. 1. As shown, the post 122 is reinforced such as with a hardened steel member 126 such as a wire embedded within the post 122 and extending into the earloop main body 124. The hardened steel wire 126 should extend through the joint between the post 122 and the earloop main body 124, i.e., into at least portions of both the post 122 and the earloop main body 124. Preferably, the hardened steel wire 126 extends approximately the entire length of the post 122. The hardened steel wire 126 preferably generally follows a center line of the post 122 and into a portion of the earloop main body 124. For example, the hardened steel wire 126 includes a turn 128 at approximately the juncture between the post 122 and the earloop main body 124. In one illustrative embodiment, the hardened steel wire 126 may be approximately 0.039 (i.e., approximately 0.04) inches in diameter and approximately 2 inches in length while the post may be approximately 0.10 inches in diameter and 0.8 inches in length.

The embedded hardened steel wire 126 has a high tensile strength so as to increase the stiffness and strength of the plastic post 122. The stiffer and stronger post 122 provides feedback to the user that the post 122 should not be bent and that the position of the post 122 should not be adjusted relative to the earloop main body 124 of the earloop 120. The embedded hardened steel wire 126 will also increase the bending life cycle of the post 122. In one example, the post 122 with the embedded hardened steel wire 126 fails after approximately 450 to 600 cycles of bending at approximately 13° from the center of the post axis with a total travel of approximately 0.25 inches per side. In contrast, the post 122 without an embedded hardened steel wire fails after approximately 40 cycles. As is evident, the embedded hardened steel wire 126 helps to minimize breakage of the earloop post 122 and thus increases the reliability, quality, and useful life of the headset 100.

As shown in FIG. 3, the earloop main body 124 may also include an embedded flexible annealed steel wire 130 that is softened, can flex, and allows the region around the annealed steel wire 130 to flex. Preferably, the annealed steel wire 130 is embedded in a region of the earloop main body 124 opposite the post 122 and is adapted to curve at least partially around and behind the ear. As shown, the earloop main body 124 may have an arcuate or crescent shape to wrap around and securely grasp the user's ear, although other configurations may be employed. For example, the inner, skin-contacting surface of the earloop main body 124 may have an arcuate shape, whereas the outer surface may be substantially rectilinear.

In a preferred embodiment, the earloop 120 may be formed using an injection molding process or any other suitable process. The earloop includes plastic and elastomeric materials. The material for the connecting, rigid curved stabilizer, and rigid tail tip portions 124*a*, 124*b*, 124*d* of the main body 124 as well as the post 122 may be a rigid plastic, e.g., PC/ABS, while the material for the flexible tail portion 124*c* may be an a flexible rubber, e.g., thermo plastic urethane (TPU). The injection molding process is optionally a two stage process. In the first stage, the connecting portion 124*a*, the rigid curved stabilizer portion 124*b* and the rigid tail tip portion 124*d* of the main body 124 as well as the post 122 are formed from a plastic material using a plastic injection molding machine. A wire insert also inserts the hardened steel member 126 and the flexible annealed steel wire 130 into the plastic injection molding machine. In the second stage, the injection molded plastic shape goes into another injection molding machine that produces the rubber adjustable tail portion 124*c*, optionally over one end portion of the flexible annealed steel wire 130.

While the preferred embodiments of the present invention are described and illustrated herein, it will be appreciated that they are merely illustrative and that modifications can be made to these embodiments without departing from the spirit and scope of the invention. Thus, the invention is intended to be defined only in terms of the following claims.

What is claimed is:

1. An earloop for a headset, comprising:

an earloop main body having a connecting portion and a stabilizer portion, the stabilizer portion being configured to be positioned at least partially over, around and behind a user's ear;

a post extending from the connection portion of the earloop main body, the post being configured to be inserted into a corresponding opening defined in an audio receiver and/or transmitter assembly; and a hardened steel member embedded within the earloop and extending from the post into the connection portion of the earloop main body.

2. The earloop of claim 1, wherein the hardened steel member is approximately 2 inches in length.

3. The earloop of claim 1, wherein the hardened steel member extends substantially an entire length of the post.

4. The earloop of claim 3, wherein the post is approximately 0.8 inches in length.

5. The earloop of claim 1, wherein the hardened steel member includes a bend at approximately a juncture between the connecting portion of the earloop main body and the post.

6. The earloop of claim 1, wherein the post is integrally formed with the earloop.

7. The earloop of claim 1, wherein the hardened steel member is approximately 0.04 inches in diameter.

8. The earloop of claim 7, wherein the post is approximately 0.1 inches in diameter.

9. A headset, comprising:

an earloop having:

an earloop main body having a connecting portion and a stabilizer portion, the stabilizer portion being configured to be positioned at least partially over, around and behind a user's ear, a post extending from the connection portion of the earloop main body, and a hardened steel member embedded within the earloop and extending from the post into the connection portion of the earloop main body; and an audio assembly having at least one of a receiver element configured to be positioned near the user's ear and a transmitter element, the audio assembly defining an opening configured to receive the post therethrough, the audio assembly being positionable along a length of the post and rotatable about the post.

10. The headset of claim 9, wherein the audio assembly includes a rubber grommet disposed within the audio assembly opening to provide a frictional fit between the audio assembly opening and the post.

11. The headset of claim 9, wherein the hardened steel member is approximately 2 inches in length.

12. The headset of claim 9, wherein the hardened steel member extends substantially an entire length of the post.

13. The headset of claim 12, wherein the post is approximately 0.8 inches in length.

14. The headset of claim 9, wherein the hardened steel member includes a bend at approximately a juncture between the connecting portion of the earloop main body and the post.

15. The headset of claim 9, wherein the post is integrally formed with the earloop.

16. The headset of claim 9, wherein the hardened steel member is approximately 0.04 inches in diameter.

17. The headset of claim 16, wherein the post is approximately 0.1 inches in diameter.

* * * * *